US005507233A

United States Patent [19]

Kwon et al.

[11] Patent Number: 5,507,233

[45] Date of Patent: Apr. 16, 1996

[54] POWER AND FREE CONVEYOR UTILIZING A PAIR OF SWINGING HOOKS

[75] Inventors: O-Won Kwon; Young-Su Song, both of Ulsan-Si, Rep. of Korea

[73] Assignee: Hyundai Heavy Industries Co., Ltd., Ulsan-Si, Rep. of Korea

[21] Appl. No.: 257,019

[22] Filed: Jun. 8, 1994

[30] Foreign Application Priority Data

Sep. 1, 1993 [KR] Rep. of Korea ..... 93-17374

[51] Int. Cl.[6] ..... B61B 3/00

[52] U.S. Cl. ..... 104/172.4; 104/130.01

[58] Field of Search ..... 104/172.2, 172.4, 104/172.1, 130.01

[56] References Cited

U.S. PATENT DOCUMENTS

| | | | |
|---|---|---|---|
| 3,662,688 | 5/1972 | Desilets et al. . | |
| 3,667,399 | 6/1972 | Czarnecki . | |
| 3,690,269 | 9/1972 | Hempstead | 104/172.4 |
| 3,726,233 | 4/1973 | Swartz | 104/172.4 |
| 3,726,234 | 4/1973 | Dema et al. | 104/172.4 |
| 3,874,304 | 4/1975 | Robert | 104/172.4 |
| 4,031,829 | 6/1977 | Bell et al. | 104/172.4 |
| 4,428,299 | 1/1984 | Wakabayashi | 104/172.4 |
| 4,542,698 | 9/1985 | Wakabayashi | 104/172.4 |

OTHER PUBLICATIONS

"Featured Parts of Nest Pak", Anchor Conveyor Company Brochure no date.

*Primary Examiner*—Mark T. Le

*Attorney, Agent, or Firm*—Nikaido Marmelstein Murray & Oram

[57] ABSTRACT

The present invention relates to power and free conveyor capable of loading a carrier, and particularly the present invention relates to a power and free conveyor in which a carrier moving is made possible by a power line interrupter without a separate device, a carrier and dog projection preventing device is not needed on a group rail, and particularly, the contact noise generated between the dog and a forcing-up cam is eliminated during the stop of the carrier, so that the working environment should be improved, and that disorders should be reduced.

1 Claim, 9 Drawing Sheets

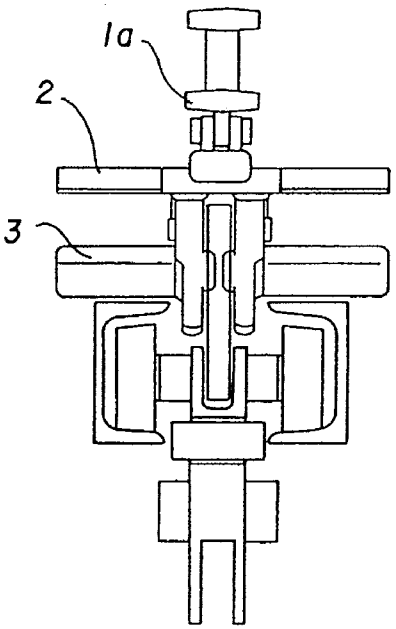
FIG. 1D
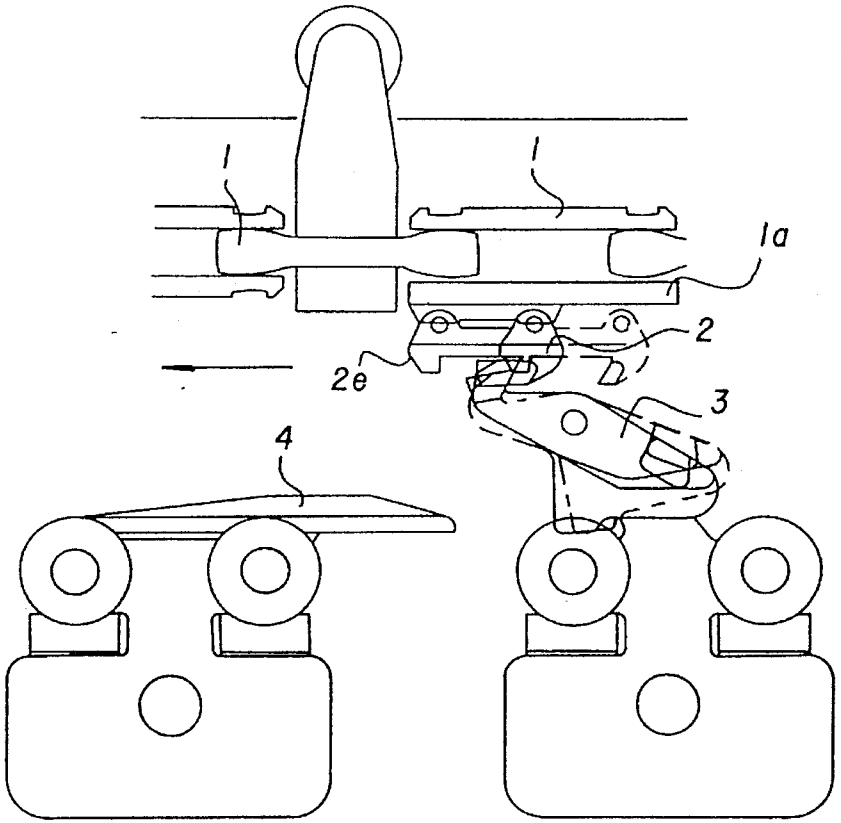
FIG. 1C
FIG. 1B
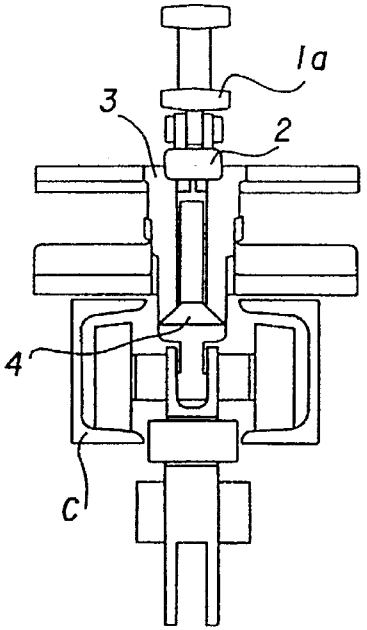
FIG. 1A

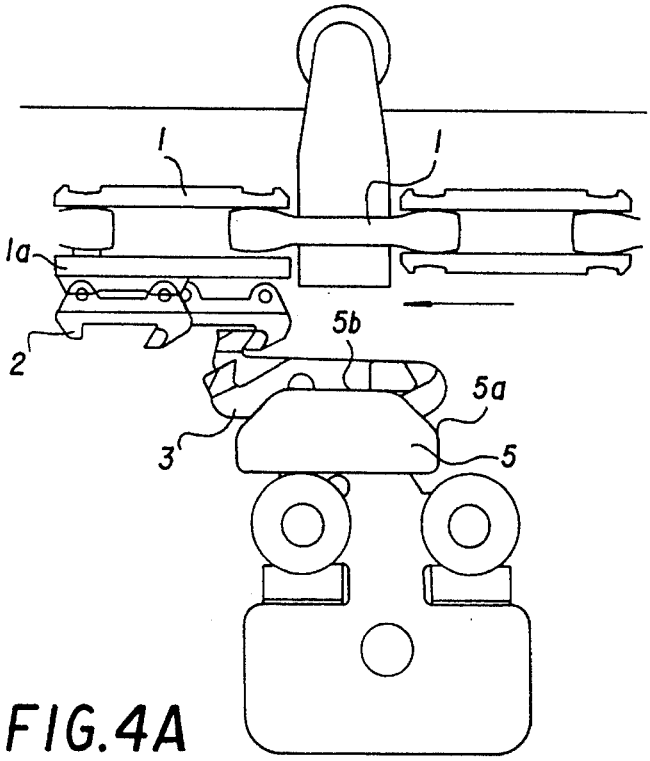
FIG.4A
FIG.4B
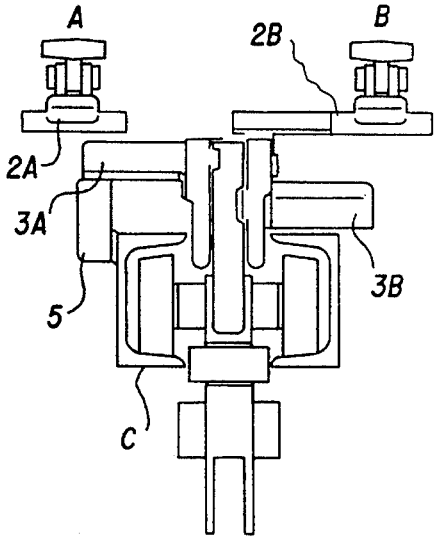
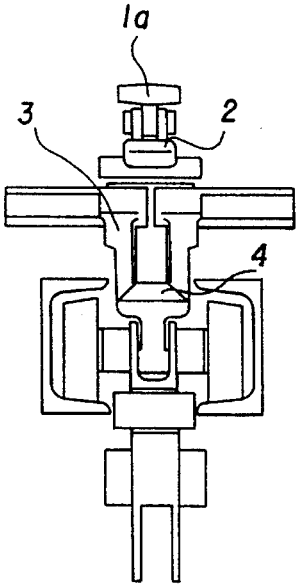
FIG.2A
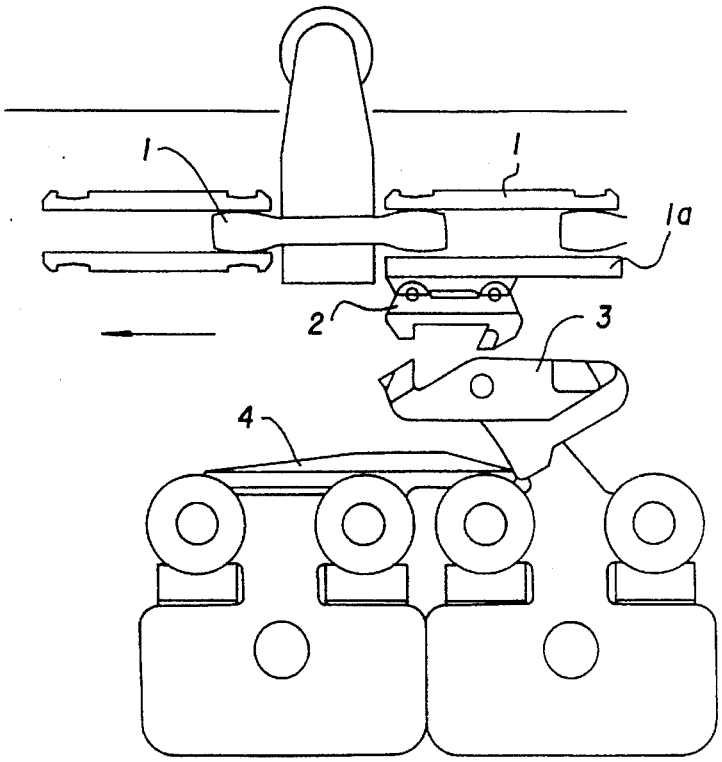
FIG.2B

FIG.6
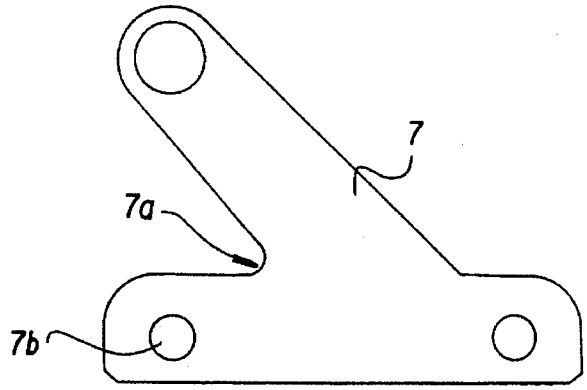
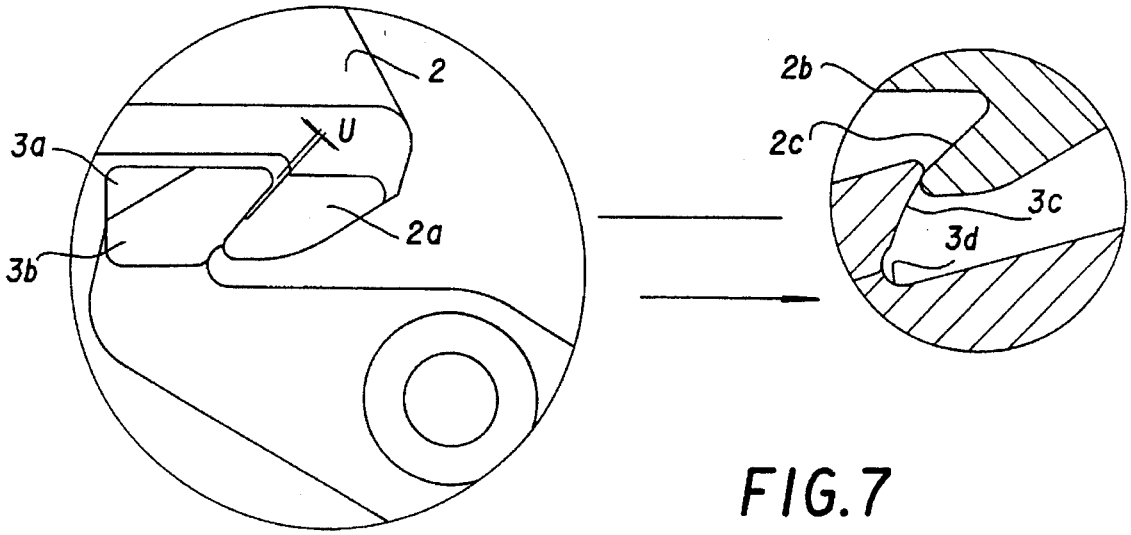
FIG.7

POWER AND FREE CONVEYOR UTILIZING A PAIR OF SWINGING HOOKS

FIELD OF THE INVENTION

The present invention relates to a power and free conveyor capable of loading a carrier, and particularly the present invention relates to a power and free conveyor in which a carrier is made to move through the use of a power line interrupter without the need for a separate device. A carrier and dog projection preventing devices are not needed on the group rail, and particularly, the contact noise generated between the dog and a forcing-up cam is eliminated during the stopping of the carrier which improves the working environment and reduces disorder.

BACKGROUND OF THE INVENTION

Conventionally there existed a power and free conveyor which included: two power lines disposed in parallel over a certain interval; a free line disposed along and below the two power lines; a plurality of swinging hooks installed at certain intervals at the side of the power lines; a dog and a hook for forcing-up a cam meshed with the hook on a plurality of carriers of the side of the free line.

In this conveyor, however, the structures of the various functional rails which are accompanied to the power and free conveyor are very complicated. Further, severe noise is generated during the stopping of the carrier due to interferences between the chain dog and the carrier cam, and between the dog and the stopper cam.

Recently, there has appeared a demand for a power and free conveyor in which the structure is simple and the noise level is very low.

SUMMARY OF THE INVENTION

Therefore it is the object of the present invention to provide a power and free conveyor, in which where a carrier is moved or a carrier is stopped at the power line interrupter, the function is performed by means of upper and lower swinging hooks, a pusher and a cam without the need for a separate device; upper and lower plates are simultaneously actuated at the group rails; and a rail switching device with a step formed for restricting the rotation relative to the cam is provided so as to prevent the collision between the swinging hook of the carrier and an opposite power line chain dog; so that, during a succeeding or piling-up, the chain dog of the power line should be able to move without contacting with the swinging hook or the cam, thereby reducing the noise and also reducing the load.

BRIEF DESCRIPTION OF THE DRAWINGS

The above object and other advantages of the present invention will become more apparent by describing in detail the preferred embodiment of the present invention with reference to the attached drawings in which:

FIG. 1 illustrates a state that the upper and lower swinging hooks of the present invention connect and disconnect the power line to and from the carrier;

FIG. 2 illustrates a state that the swinging hook of the carrier is disconnected from the power line by a pusher during the piling-up of the carriers of the present invention;

FIG. 4 is a detailed illustration of the state of FIG. 3, showing the connections of the chain dogs of the two power lines with the left and right members of the swinging hook;

FIG. 6 is a frontal view of a swinging hook support according to the present invention;

FIG. 7 is a detailed illustration of the engagement of the swinging hook with the chain dog of the present invention;

DESCRIPTION OF THE PREFERRED EMBODIMENT

Figure 3:
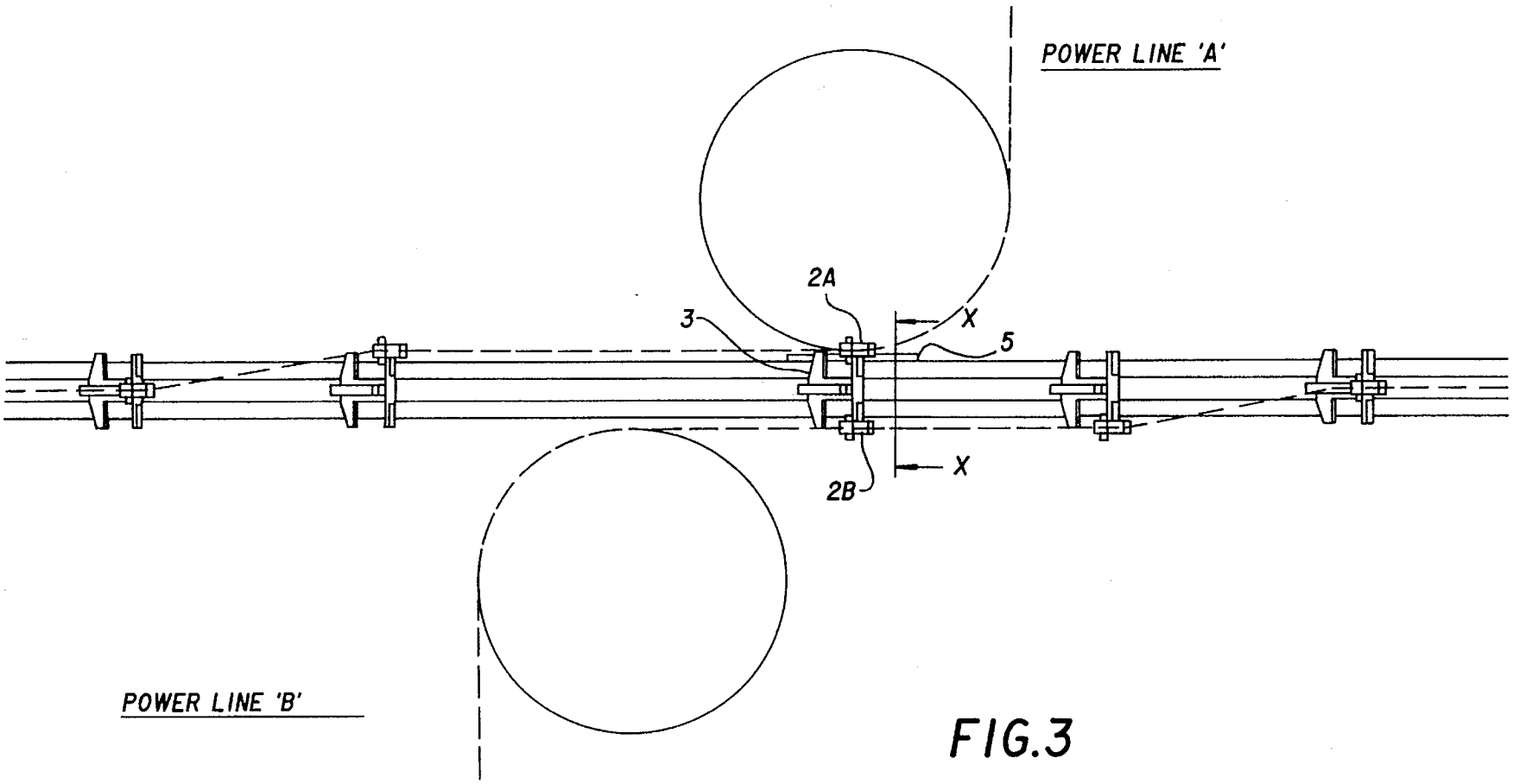
FIG. 3 illustrates the carrier moving method during a carrier succeeding interval of the present invention, showing the arrangement of the free line and the power lines and the connections of the chain dog with the swinging hook.

A power line is disposed above a free line. A chain dog 2 with an outrun preventing step **2*d* formed thereon and with an engagement step 2*a* formed thereon (having an engagement portion 2*c* having an extra gap U) is attached on the power line. On the carrier of the free line C, there are installed a pusher 4 having a curved step 4*a*, and a swinging hook 3 on which an outrun preventing step 3*a*, and engagement step 3*b*, an engagement portion 3*c*, an inclined step 3*e*, a rearwardly pushing step 3*g*, a reverse run preventing step 3*h*, and a hinge 3*k* are formed. Further, there is provided a swinging hook support 7 having an interference excluding groove 7*a* which is activated when the pusher 4 pushes the swinging hook 3. Further, there is also provided a stopper cam 6 having a vertical face 6*c*, a horizontal portion 6*b* and an inclined portion 6*a* for separating the carrier from the chain dog 2**.

Further, there is also provided a rail switching device 8 on which a rotation restricting step **8*b* and a cam 8*a* are formed in which the upper and lower plates are simultaneously activated at the group rails, and which prevent the collision between the swinging hook 3 of the carrier and the chain dog 2** of the power line.

In the drawings, reference code 1 indicates a driving chain, **1*a* indicates a chain dog bracket, 2*f* indicates an engaging groove, 5** indicates a succeeding cam, D and E indicate power lines of the group rails, and F and G indicate free lines of the group rails.

In the device of the present invention constituted as above, when the power lines A and B are connected with the carrier as shown in FIG. 1, the swinging hook 3 is inclined by the front inclined face **2*e* of the chain dog 2, and then, the hook rises from the engagement groove 2*f* so as to be engaged with the engagement step 2*c***.

Further, the chain dog 2 and the swinging hook 3 are respectively provided with the outrun preventing steps **2*d* and 3*a*, and therefore, the swinging hook 3** is restricted by the chain dog.

As shown in FIG. 2, if the carrier comes into contact with the pusher 4 of the carrier, which is running-ahead, during the carriers movement along the power lines A and B, the swinging hook 3 is inclined by the pusher 4, so that the carrier is stopped by being separated from the chain dog 2 of the power line.

Meanwhile, the engagement portions 3*c* and 2*c* of the swinging hook 3 and the chain dog 2 have an arcuate form around the hinge 3*k*, and therefore, the swinging hook 3 continuously moves until it departs from the chain dog 2, so that it moves up to the point where the swinging hook 3 departs from the chain dog 2. Under this condition, the swinging hook 3 advances slightly further owing to the inertia of the carrier so as for it to be inclined, and then, the swinging hook 3 is completely detached from the chain dog, with the result that it does not come into contact with the next chain dog, thereby reducing noise.

Figure 5B:
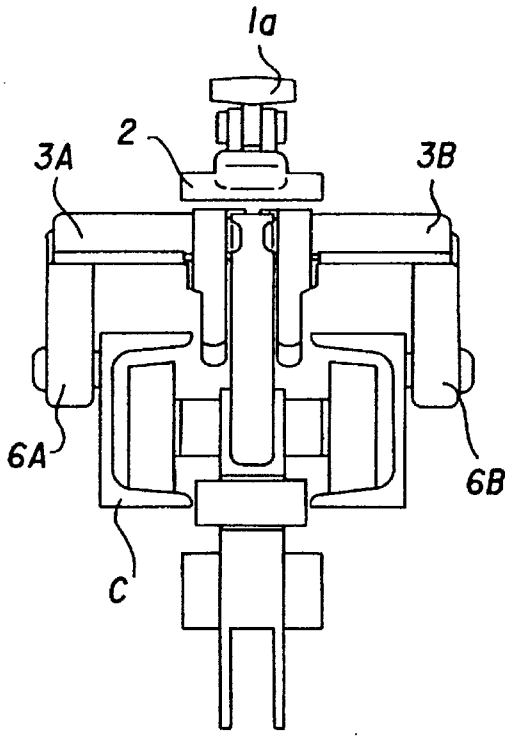
FIG. 5 illustrates the state of the swinging hook and a stopper, with the carrier being stopped by the stopper of the present invention.
Figure 5A:
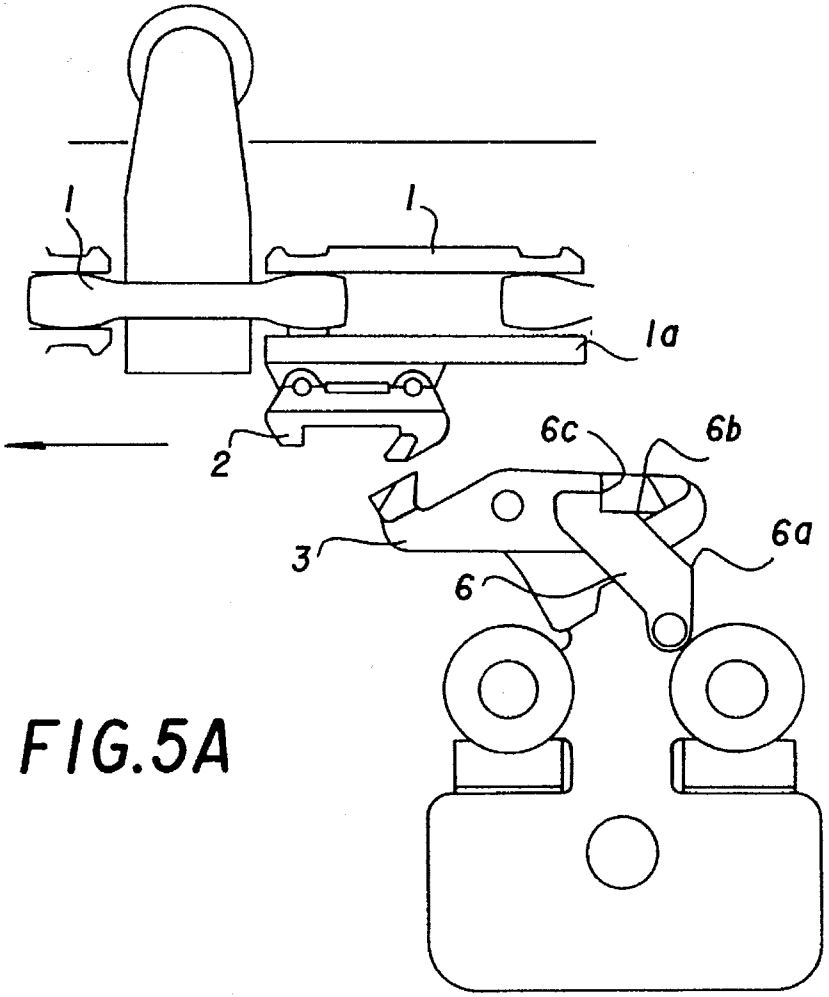
Figure 8:
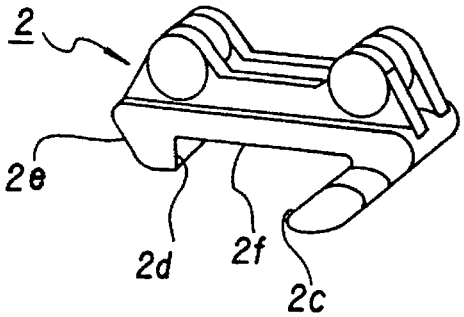
FIG. 8 is a perspective view of the chain dog according to the present invention.
Figure 9:
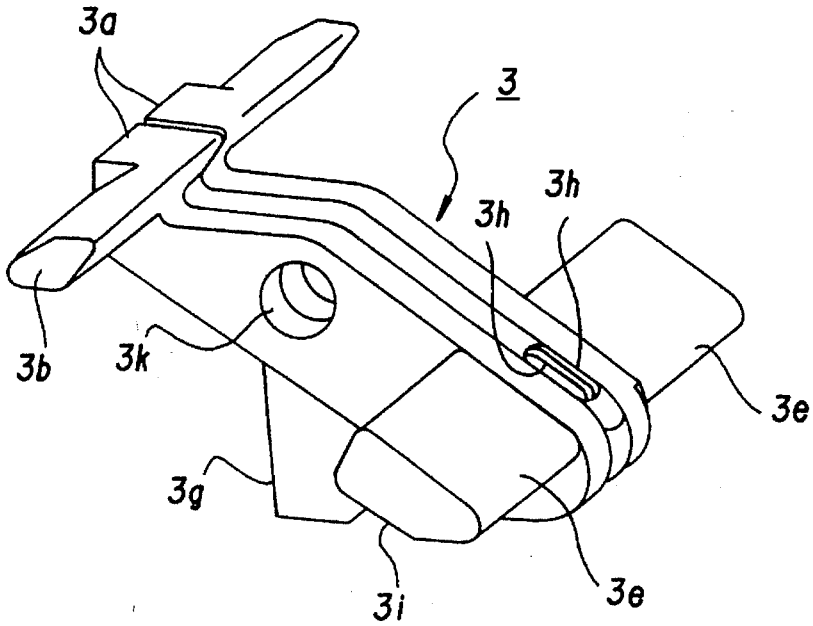
FIG. 9 is a perspective view of the swinging hook and the chain dog according to the present invention.
Figure 10:
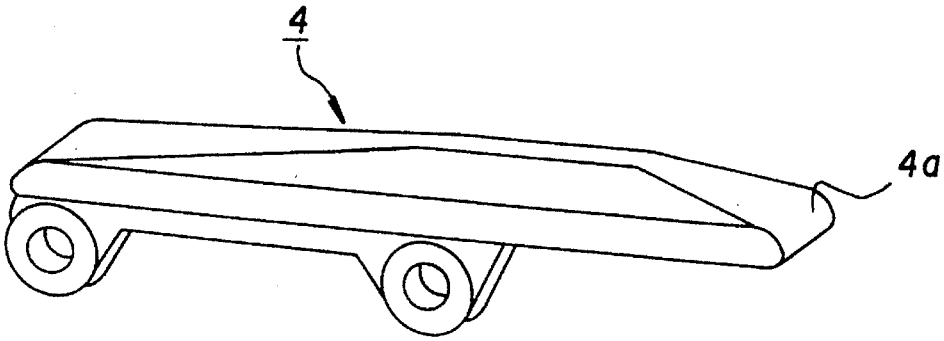
FIG. 10 is a perspective view of the pusher according to the present invention.

As shown in FIG. 5, the steps 3*e* of the upper and lower swinging hooks 3 rise along the inclined face 6*a* of the stopper 6 which is installed at the outside of the free line. Then the carrier further advances up to the vertical face 6*c* owing to the inertia. The swinging hook 3 of the carrier then completely departs from the chain dog 2.

Conventionally, a carrier stopping device is required such as a device for separating the carrier of the chain dog. However, according to the present invention, the stopper which has the inclined portion and the horizontal portion are used and are capable of carrying out the conventional two functions. Therefore, interference between the carrier and the chain dog is excluded, so that noise is reduced.

As shown in FIGS. 3 and 4, the power lines A and B are disposed so as to be overlapped in parallel for a certain interval, and the free line C is disposed below the power lines in the middle.

On the power lines A and B, a chain dog 2 is attached which is provided with an engaging portion 2*c* and an outrun preventing step 2*d*. On the carrier of the free line side, a swinging hook 3 and a pusher 4 are installed, and the swinging hook 3 is provided with an outrun preventing step 3*a*, an engagement step 3*b*, and inclined step 3*e* and a reverse run preventing step 3*h*, while the pusher 4 is provided with a curved step 4*a*. The chain dogs 2A and 2B of the power lines A and B are made to be engaged with the two swinging hooks respectively. When the pusher 4 pushes the swinging hook 3, the swinging hook support 7 having an interference excluding groove 7*a* is activated.

In the power and free conveyor constituted as described above, a succeeding cam 5 is installed on the side of the power line A, and so, if the swinging hook 3A of the A side of the carrier is separated from the power line A, then the carrier is connected to the power line B. Under this condition, the inclined step 3*e* of the swinging hook 3 is made to rise by the cam which is installed at the outside of the rails, so that the A side member of the swinging hook 3 should be separated from the chain dog 2A of the power line A.

The pair of the swinging hooks can be independently oscillated from each other, and therefore, the two members can be individually connected or separated. Therefore, according to the present invention, the chain dog and the carrier are connected and separated in a definite manner.

Figure 11B:
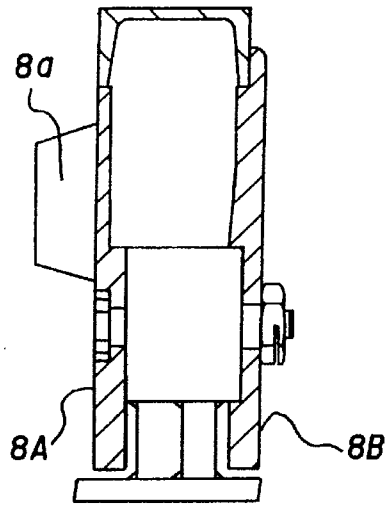
FIGS. 11 and 12 illustrate the carrier moving along the group rails according to the present invention.
Figure 11A:
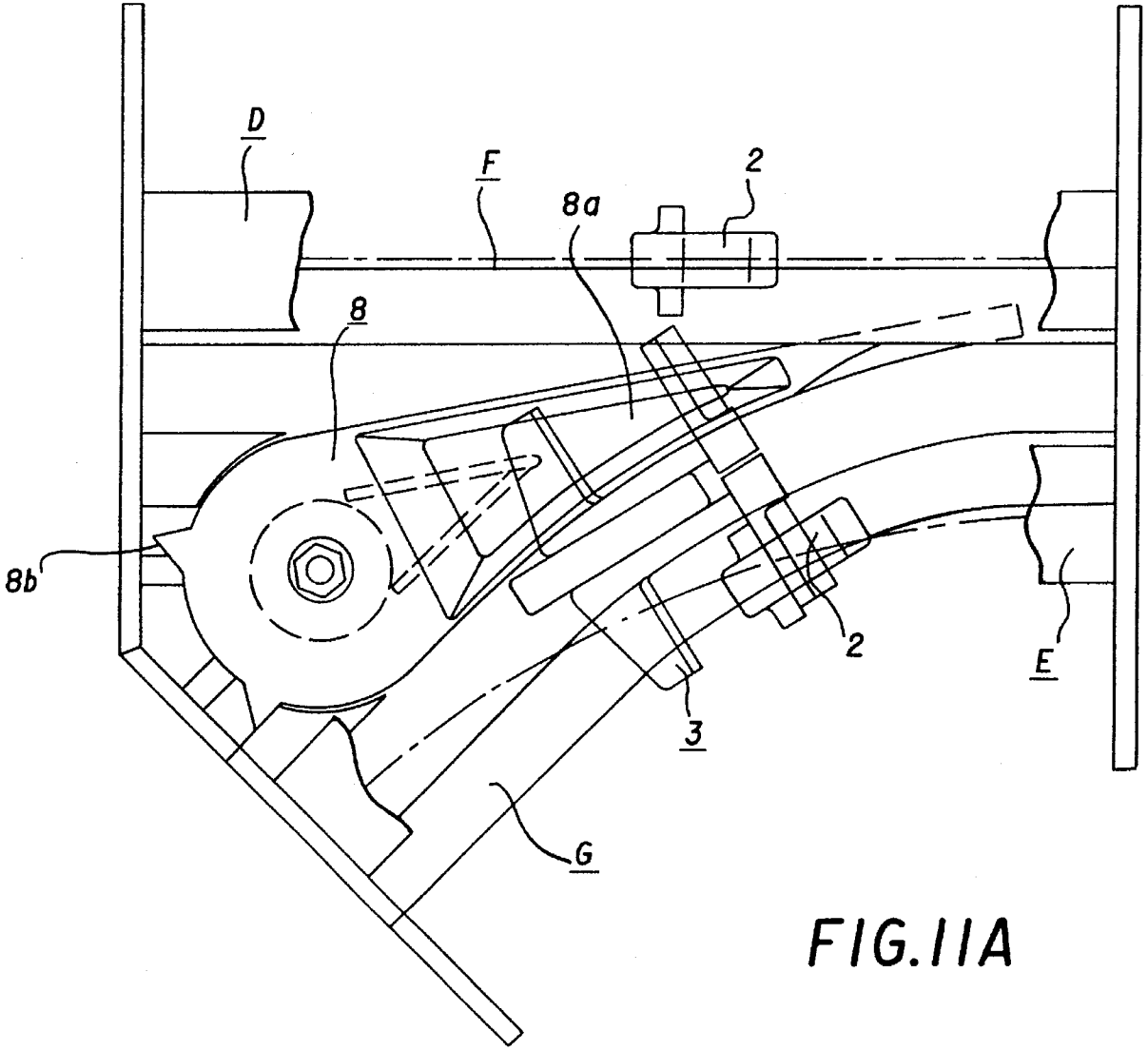
Figure 12A:
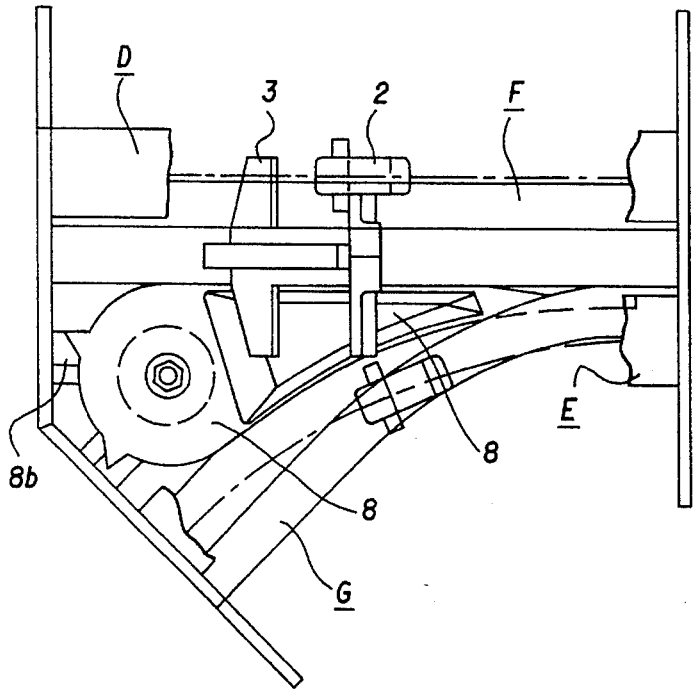
Figure 12B:
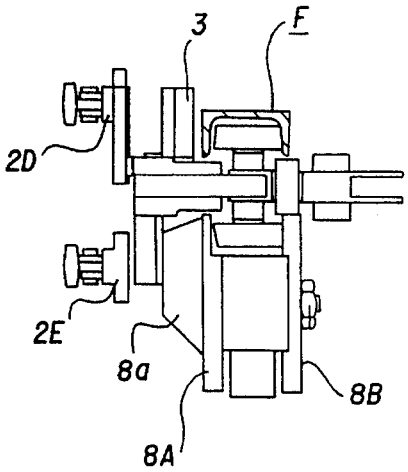
Figure 12C:
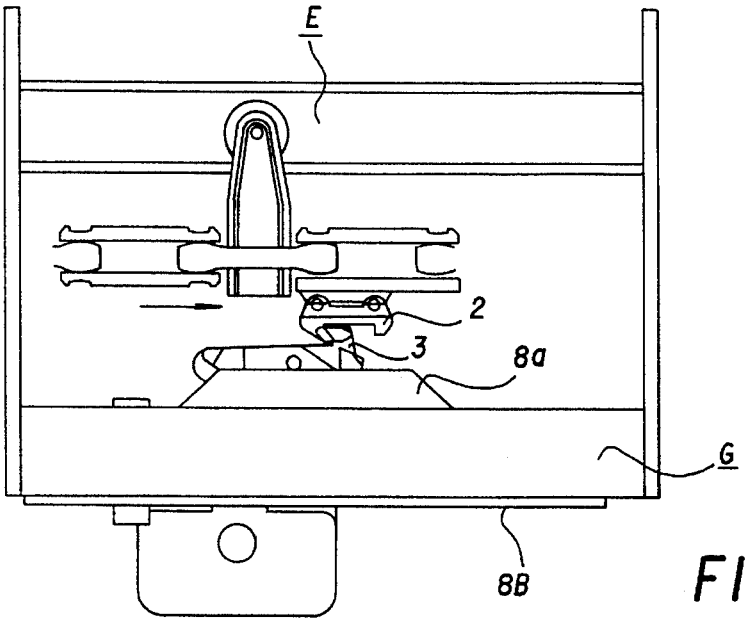
Figure 13A:
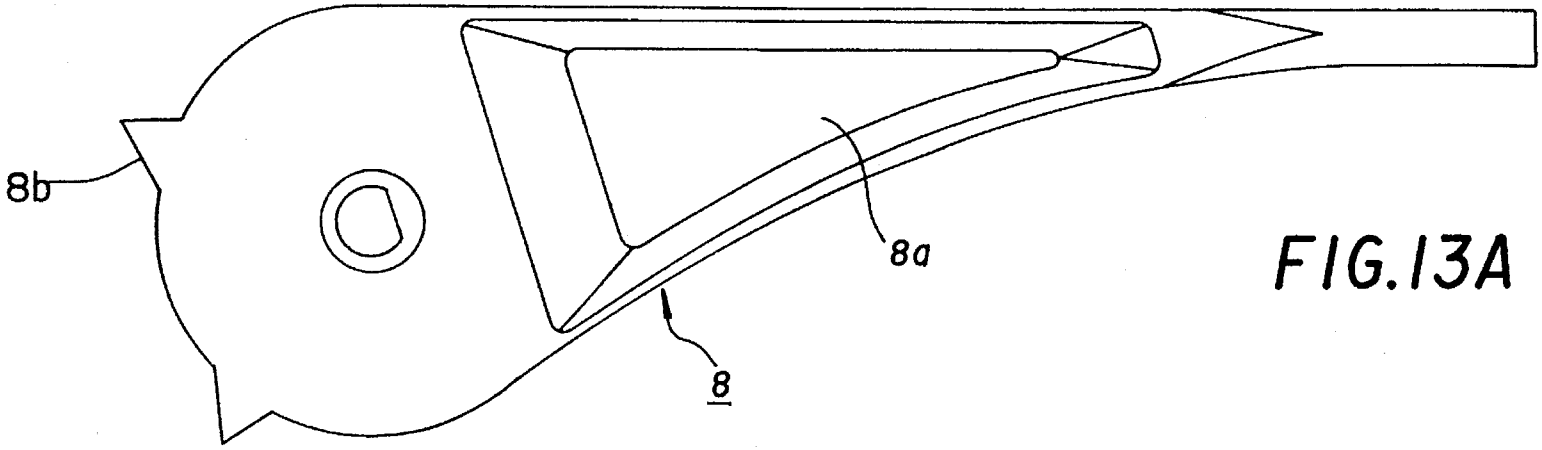
FIG. 13 is a detailed illustration of the line switching device according to the present invention.
Figure 13B:
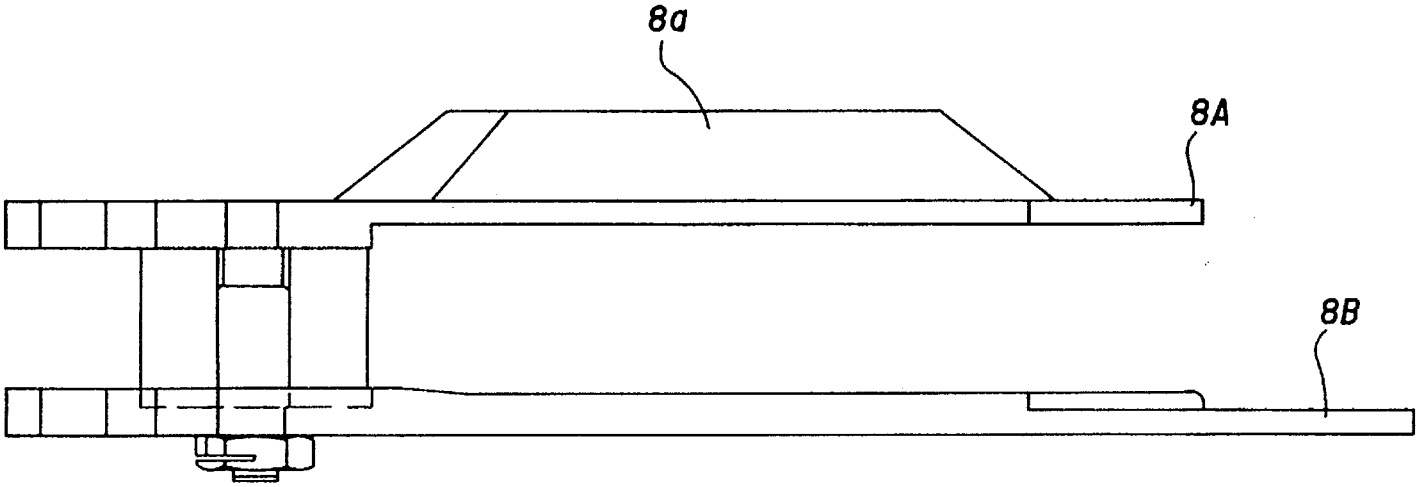

In the power and free conveyor according to the present invention, two free lines are converged into one, and, above the free line, the power lines are disposed, thereby forming a group rail. As shown in FIGS. 11 and 12, in order to prevent the collision between the chain dog of the carrier of the free lines F and G and the chain dog of the power lines D and E, the conventional apparatus uses a cam which is for forcing up the chain dog, and which is actuated by a pneumatic cylinder which is disposed at the outside of the two power lines.

On the other hand accordingly to the present invention, as shown in FIGS. 11 and 12, the switching device 8 comprises a hinged switch member, including upper and lower elements 8A and 8B, which can be turned to the left or right by a guide roller 10 of the carrier, as the carrier passing the switching device 8 at the location of converged lines D,E, F,G. Further, a fixed cam 8*a* is provided on top of the hinged switch member of the switching device 8. Thus the inclined step 3*e* of a respective right or left swinging hook 3 which is not currently in engagement with a chain dog 2 of either power line D or E, as the carrier passing switching device 8, is made to rise by the cam 8*a*, as the inclined step 3*e* passing over the cam 8*a*, such that the respective right or left swinging hook 3 is pivoted out of the position of possible collision with a chain dog 2. Therefore, without any separate chain dog forcing device, the line switching operation the present invention can be carried out only with a line switching device 8 provided with a fixed cam 8*a*.

According to the present invention as described above, even without any separate device in the power line interrupter, the function can be surely carried out. Further, noise is reduced compared with the conventional power and free conveyor. Further, the price of the apparatus is lowered, and disorders are reduced, as well as reducing the manufacturing cost.

What is claimed is:

1. A power and free conveyor, comprising:

first and second power lines having chain dogs, said power lines being converged at a location;

at least two free lines disposed under said power lines and supporting a carrier having guide rollers, said free lines being converged at said location;

a swinging hook assembly having right and left swinging hook members hinged on a single axis on said carrier, said right and left swinging hook members being arranged for engaging the chain dogs of said first and second power lines, respectively;

a rail switching device positioned at said location of converged lines, said rail switching device including a hinged switch member which is configurated and arranged to be turned to either switching position by a direct engagement with one of said guide rollers of said carrier as said carrier entering said location of converged lines, said rail switching device further including a cam surface on top of the switch member for preventing one of said right and left swinging hook members that is not currently in engagement a chain dog from engaging a chain dog as said carrier passing said location of converged lines.

* * * * *